US010573996B2

(12) United States Patent
Shirk/Heath et al.

(10) Patent No.: US 10,573,996 B2
(45) Date of Patent: Feb. 25, 2020

(54) INTEGRATED FORCE GAUGE CABLE MECHANISM

(71) Applicant: International Business Machines Corporation, Armonk, NY (US)

(72) Inventors: Sandra J. Shirk/Heath, Rochester, MN (US); Justin C. Rogers, Rochester, MN (US); Mark G. Clark, Rochester, MN (US); Lee N. Helgeson, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/824,338

(22) Filed: Nov. 28, 2017

(65) Prior Publication Data

US 2019/0165517 A1 May 30, 2019

(51) Int. Cl.
*H01R 13/627* (2006.01)
*H01R 13/641* (2006.01)

(52) U.S. Cl.
CPC ..... *H01R 13/641* (2013.01)

(58) Field of Classification Search
CPC ..... H01R 13/6272; H01R 13/6275
USPC ..... 439/352–354, 357–358
See application file for complete search history.

(56) References Cited

U.S. PATENT DOCUMENTS 4,634,204 A * 1/1987 Detter ..... H01R 13/641 439/347
5,211,572 A * 5/1993 Comstock ..... H01R 13/6392 439/352
5,376,014 A 12/1994 Sumida
5,910,027 A * 6/1999 Wayt ..... H01R 13/641 439/352
6,409,534 B1 6/2002 Weisz-Margulescu
6,641,416 B2 * 11/2003 Schulz ..... H01R 13/641 439/153
6,860,749 B1 3/2005 Wu
6,866,542 B2 3/2005 Murayama
7,083,459 B1 8/2006 Wu et al.
7,458,144 B2 12/2008 Barina et al.
7,744,399 B1 6/2010 Gibbs et al.
7,794,263 B1 * 9/2010 Kim ..... H01R 13/741 439/357
7,824,208 B2 11/2010 Crofoot et al.
7,841,888 B2 11/2010 Xia et al.
7,892,007 B2 * 2/2011 Scherer ..... H01R 12/712 439/329
8,425,249 B2 * 4/2013 Hackett ..... H01R 13/443 439/357
8,506,319 B2 * 8/2013 Ritter ..... H01R 13/6335 439/352
8,547,691 B2 * 10/2013 Peng ..... H01R 13/6395 361/679.4
8,672,709 B2 * 3/2014 Dietz ..... H01R 13/6395 439/352
9,124,046 B2 9/2015 Ehret et al.
(Continued)

*Primary Examiner* — Thanh Tam T Le
(74) *Attorney, Agent, or Firm* — Patterson + Sheridan, LLP

(57) ABSTRACT

Aspects of the disclosure generally relate to cables and back shells having integrated force gauges. The force gauge includes a sliding member that engages features such as grooves formed in one or more surfaces of the back shell. The grooves and/or sliding member are sized and shaped such that a different forces applied to the sliding member facilitates movement between respective grooves.

20 Claims, 6 Drawing Sheets

(56) References Cited

U.S. PATENT DOCUMENTS

| | | | | |
|---|---|---|---|---|
| 9,276,344 | B2 | 3/2016 | Schmatz et al. | |
| 9,379,484 | B2 * | 6/2016 | Phillips | H01R 13/62905 |
| 9,437,971 | B2 * | 9/2016 | Yang | H01R 13/6275 |
| 2005/0064756 | A1 | 3/2005 | Hsiao et al. | |
| 2017/0170595 | A1 | 6/2017 | Schaefer et al. | |
| 2017/0192183 | A1 | 7/2017 | Wong et al. | |
| 2017/0192188 | A1 | 7/2017 | Zhang et al. | |

* cited by examiner

INTEGRATED FORCE GAUGE CABLE MECHANISM

BACKGROUND

Field

The present disclosure generally relates to cable connectors, and more specifically, to cable connectors having an integrated force gauge.

Description of Related Art

Conventionally, cables are utilized to facilitate connections between electrical components. Often times, cable receptacles, e.g., ports and/or connectors, are located in difficult to reach or difficult to see locations. Because of the location of cable receptacles, a user relies on tactile feel, or audible/visual cues to confirm that a cable has been properly seated. However, even if the cable feels or otherwise appears to be properly seated, the cable may not be properly secured in the receptacle. For example, a cable may be in electrical contact within the receptacle, and may even illuminate an indication light, even though the cable is not latched or fully seated. In such an instance, the likelihood if inadvertent cable disengagement is increased.

The issue of improperly seated cables is particularly prevalent in cases where there are several forces a user needs to overcome in order to seat the cable into a receptacle. For example, a cable may need to overcome the force of a receptacle housing, a heatsink force, and the mating connector contact force.

There is a need for an apparatus to facilitate confirmation that a cable is properly seated.

SUMMARY

Aspects of the disclosure generally relate to cables and back shells having integrated force gauges. The force gauge includes a sliding member that engages features such as grooves formed in one or more surfaces of the back shell. The grooves and/or sliding member are sized and shaped such that different forces applied to the sliding member facilitate movement between respective grooves.

In one aspect, a cable component comprises a back shell having one or more grooves formed in surfaces thereof, and a sliding member coupled to the back shell and positioned adjacent to the one or more grooves. The sliding member has at least one engagement member formed on a surface thereof for engaging the one or more grooves. The sliding member is configured to move in a first direction upon application of a first force and move in a second direction upon application of a second force. The first force is greater than the second force.

In another aspect, a cable comprises a bulk wire, a back shell coupled to the bulk wire and having one or more grooves formed in surfaces thereof, and a sliding member coupled to the back shell and positioned adjacent to the one or more grooves. The sliding member has at least one engagement member formed on a surface thereof for engaging the one or more grooves. The sliding member is configured to move in a first direction upon application of a first force and move in a second direction upon application of a second force. The first force is greater than the second force.

In another aspect, a method comprises positioning an electrical contact of a cable in a receptacle, applying a first force to a sliding member to move the sliding member from a first position to a second position relative to a back shell of the cable, and applying a second force to the sliding member to move the sliding member from the second position to the first position relative to the back shell of the cable. The second force is directed in an opposite direction than the first force and has a smaller magnitude than the second force. The electrical contact remains positioned in the receptacle upon application of the second force.

DETAILED DESCRIPTION

Aspects of the disclosure generally relate to cables and back shells having integrated force gauges. The force gauge includes a sliding member that engages features such as grooves formed in one or more surfaces of the back shell. The grooves and/or sliding member are sized and shaped such that different forces applied to the sliding member facilitate movement between respective grooves.

Figure 1A:
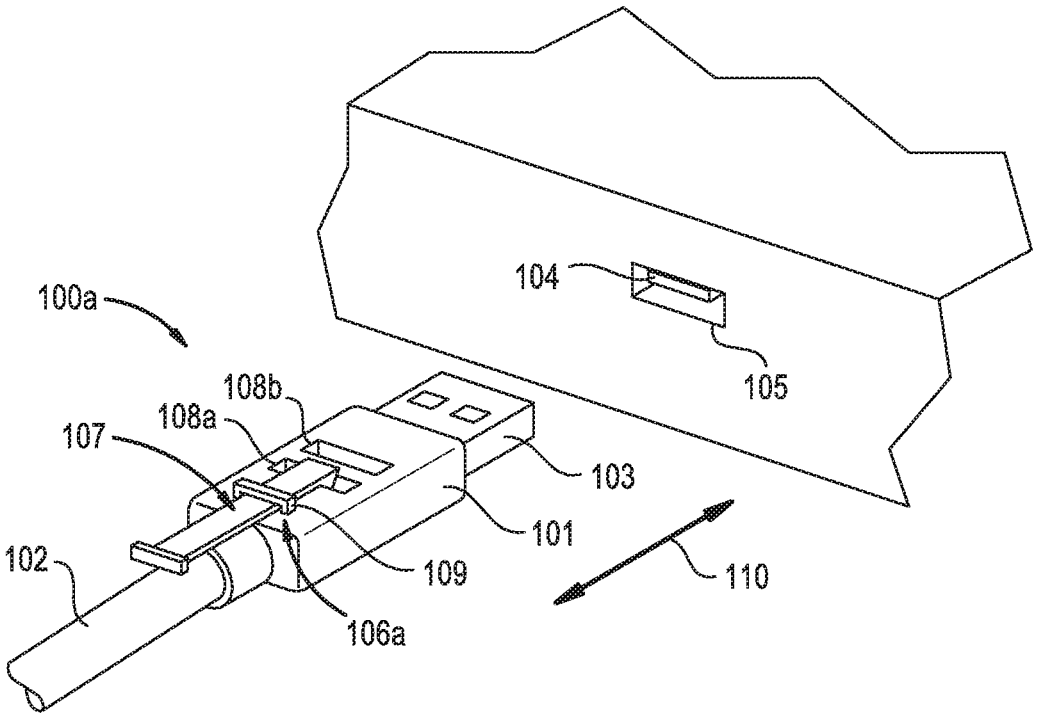
FIG. 1A is a schematic perspective view of a cable and receptacle, according to one aspect of the disclosure.
Figure 1B:
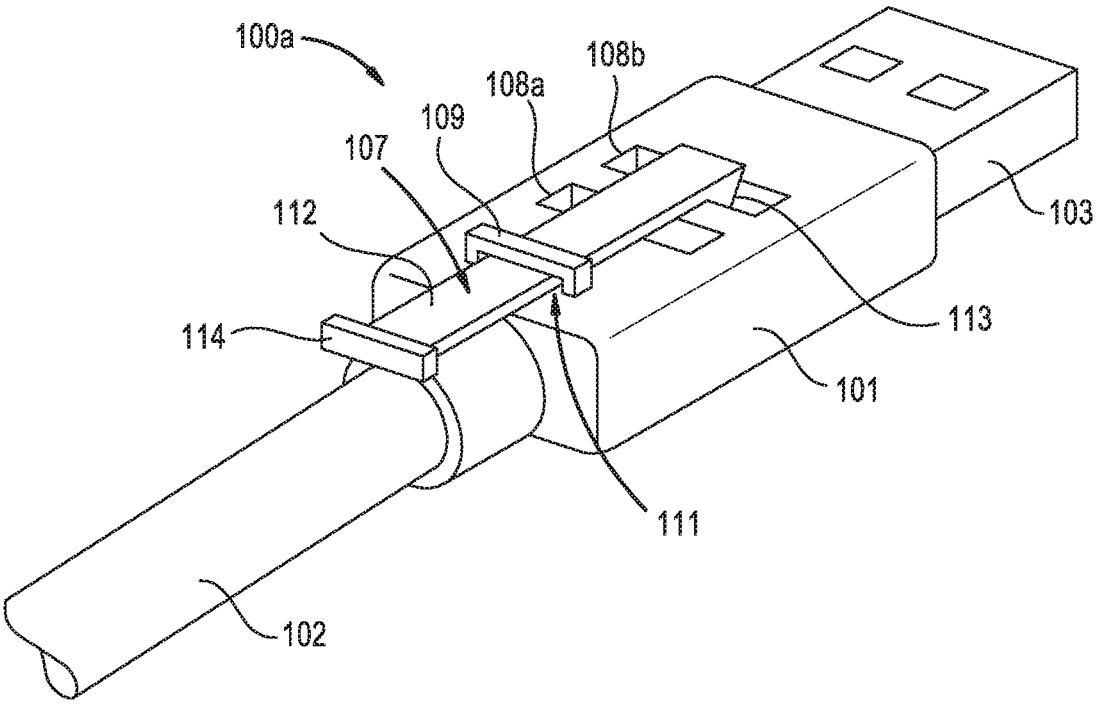
FIG. 1B is an enlarged schematic perspective view of the cable of FIG. 1A, according to one aspect.

FIG. 1A is a schematic perspective view of a cable 100*a* and a receptacle 105, according to one aspect of the disclosure. FIG. 1B is an enlarged schematic perspective view of the cable 100*a* of FIG. 1A, according to one aspect. The cable 100*a* includes a back shell 101 and a bulk wire 102 coupled to the back shell 101. An electrical connector 103 is coupled to the back shell 101 and is configured to make an electrical connection with a contact 104 located within a receptacle 105. In one example, the receptacle 105 is a port or other connector.

The back shell 101 is a metal or polymer housing, and includes a force gauge 106*a* integrally formed therewith. The force gauge 106*a* includes a sliding member 107, and one or more grooves 108*a*, 108*b* (two are shown). The sliding member 107 is coupled to the back shell 101 by a retaining member 109 formed on a surface of the back shell 101. In one example, the retaining member 109 is a U- or C-shaped member that defines an orifice 111 adjacent a surface of the back shell 101 through which the sliding member 107 is movably disposed. The retaining member 109 is sized to allow movement of the sliding member 107 in a direction indicated by arrow 110 (e.g., along a longitudinal axis of the sliding member 107), while prohibiting unintentional removal of the sliding member 107 from the retaining member 109.

The sliding member 107 includes an elongated body 112 having an engagement member 113 at a first end thereof and an optional flared member 114 at second end opposite to the first end. The engagement member 113 is a wedge-shaped or triangular-shaped member extending from a lower surface of the elongated body 112, and is positioned to engage the grooves 108*a*, 108*b*. In one example, the engagement member 113 extends across a width of the elongated body 112. It is contemplated that other engagement members, such as detents, or engagement members having different shapes, may be utilized. At an opposite end of the body 112, a flared member 114 is coupled to the elongated body 112. The flared member 114 may be, for example, a pad or other widened piece of material, configured to improve user engagement with respect to the sliding member 107. For example, the flared member 114 may improve user grip when a user is applying force to the sliding member 107. It is contemplated that in some embodiments, the flared member 114 may be omitted, or sized and shaped differently. Components of the force gauge 106*a*, including the sliding member 107, the retaining member 109, may be formed from materials such as metals or polymers.

Figure 1C:
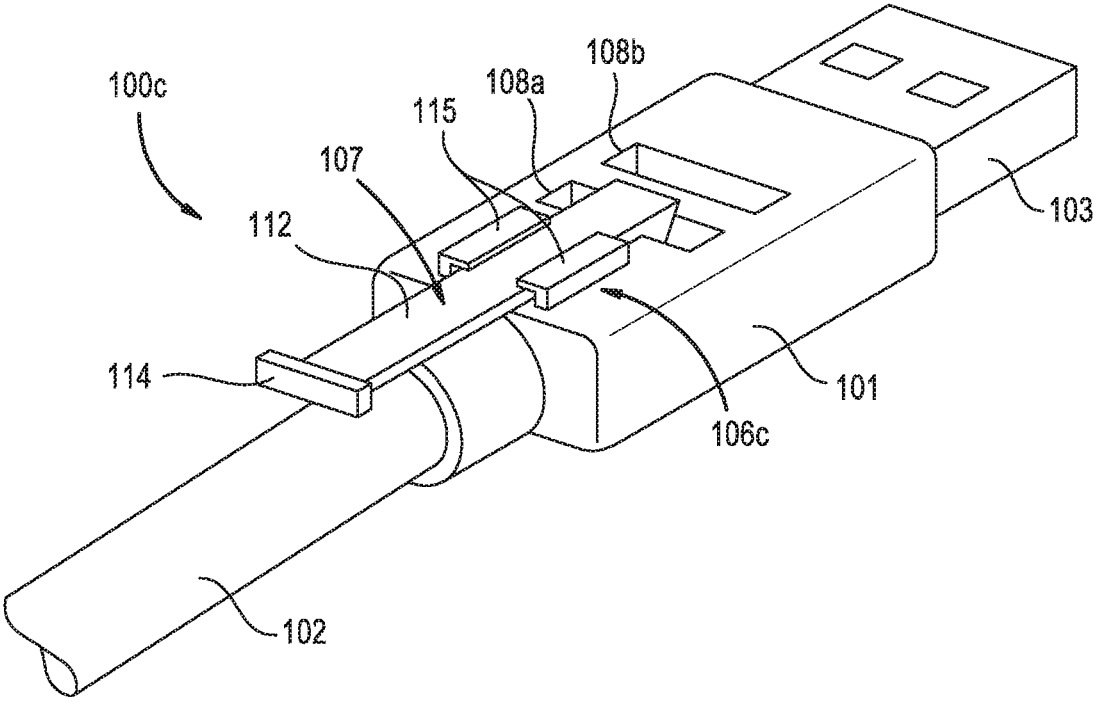
FIGS. 1C and 1D are schematic perspective views of cables, according to other aspects of the disclosure.
Figure 1D:
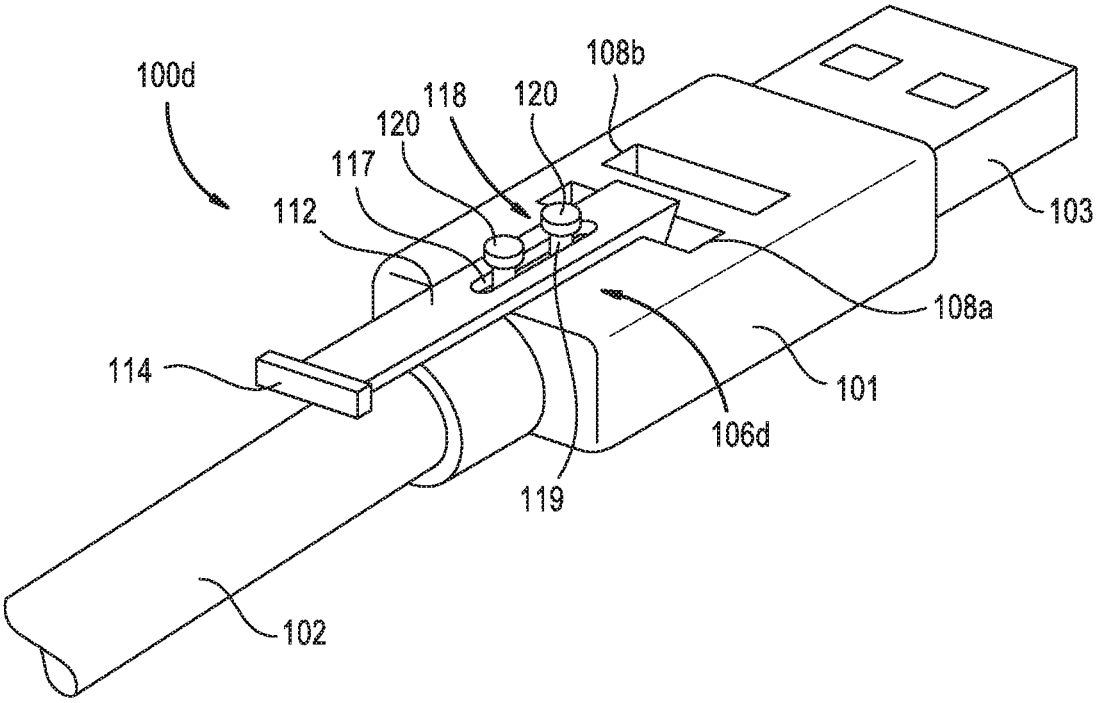

FIGS. 1C and 1D are schematic perspective views of cables 100*c*, 100*d* having force gauges 106*c*, 106*d*, respectively, according to other aspects of the disclosure. FIG. 1C schematically illustrates a cable 100*c* having a force gauge 106*c*. The force gauge 106*c* is similar to the force gauge 106*a*, but utilizes two tracks 115 for supporting the sliding member 107. Each track 115 is disposed on opposite sides of the sliding member 107, and may include a groove along an interior surface thereof in which the elongated body 112 is disposed. The elongated body of the sliding member 107 engages the groove and is maintained therein, and is permitted to slide relative to the tracks 115 within the grooves. The sizing and position of the groove and the tracks 115 may be selected to provide a desired level of retention and/or friction resistance.

FIG. 1D schematically illustrates a cable 100*d* having a force gauge 106*d*. The force gauge 106*d* is similar to the force gauge 106*a*, but utilizes a slotted pin joint for supporting the sliding member 107. In such an example, the elongated body 112 of the sliding member 107 further includes an elongated opening 117 for receiving a plurality of pins 118 therein. The pins 118 extend perpendicularly from a surface of the back shell 101. The pins 118 each include a post 119 and a cap 120 disposed on a distal end of a respective post 119. Each post 119 has a diameter smaller than a smallest width of the opening 117 to facilitate relative movement of the elongated body 112, while the cap 120 has a diameter larger than the smallest width of the opening 117 to prohibit removal of the elongated body 112 from a pin 118. In such an example, the elongated body 112 is free to actuate about the pins 118 in a direction parallel to the elongated opening 117, without being inadvertently removed therefrom. The utilization of multiple pins 118 prevents unintentional rotation of the sliding member 107, which may occur when utilizing a single pin 118. However, it is contemplated that a single pin 118, having an elongated or oval-shaped post 119 that also prevents rotation of a sliding member 107, may be utilized.

FIGS. 1A-1D illustrate several aspects of cables, however, other aspects are also contemplated. For example, it is contemplated that a cable may also include other features, such as release tabs, cable latch releases, illuminated indicators, and the like, which are not shown in the examples of FIGS. 1A-1D in order to more clearly illustrate the force gauges 106*a*, 106*c*, 106*d*.

FIGS. 2A-2E are schematic side views of a cable 100*a* during receptacle engagement, according to one aspect of the disclosure. It is contemplated that cables 100*c* and 100*d* may be used in place of cable 100*a* for purposes of this description. During operation, a cable 100*a* is inserted into a receptacle 105 to facilitate electric connections between respective contacts 103, 104 (shown in FIG. 1A). However, as described above, conventionally it is often difficult for a user to confirm that a cable has been fully seated within the receptacle. The cable 100*a* overcomes this deficiency by including an integral force gauge 106*a*.

Figure 2A:
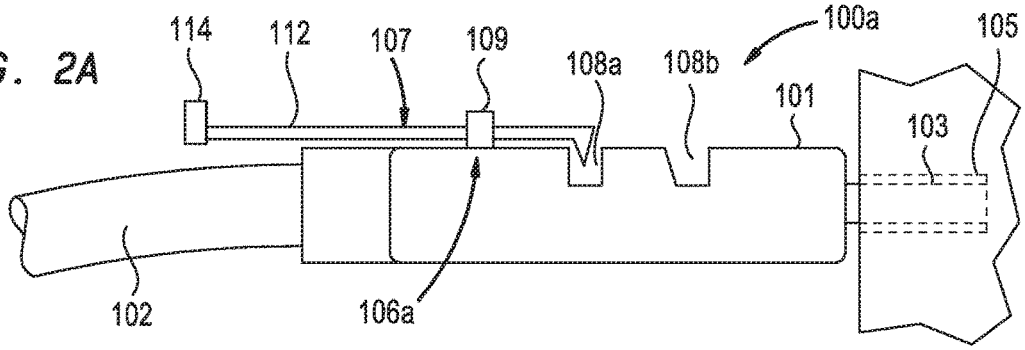
FIGS. 2A-2E are schematic side views of a cable during receptacle engagement, according to one aspect of the disclosure.
Figure 2B:
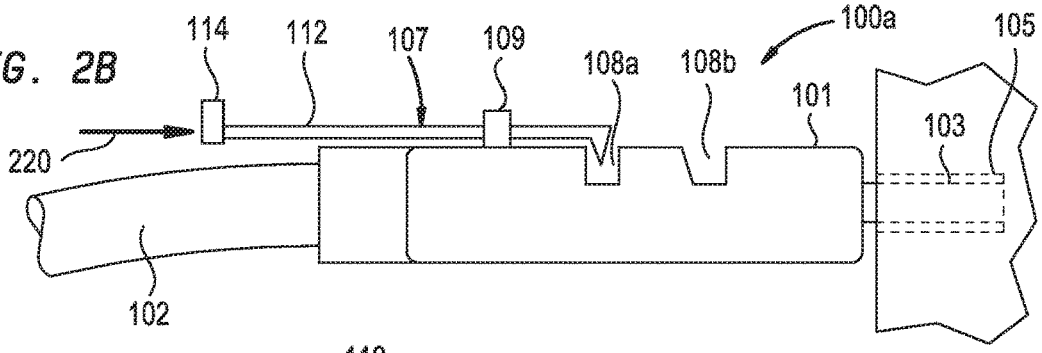

As shown in FIG. 2A, when the cable 100*a* initially engages the receptacle 105, the engagement member 113 of the force gauge 106*a* is located in a first position, e.g., the groove 108*a*. With the cable 100*a* initially seated in the receptacle 105, a user applies force to a distal end the sliding member 107, as shown in FIG. 2B. The distal end of the sliding member 107 may optionally include a flared member 114 to increase user grip or engagement of the sliding member 107. Force is applied by a user in a direction indicated by arrow 220, which is generally parallel to the sliding member 107 of the force gauge 106*a*. Once a sufficient amount of predetermined force is applied, for example, about 20 pounds of force, the engagement member 113 disengages from the groove 108*a* and is actuated towards the second groove 108*b*, as shown by arrow 221. It is contemplated that the predetermined amount of force may be adjusted by varying one or more of the angle of the engagement member 113, the angle of sidewalls of the groove 108*a*, material compositions, or other factors which adjust frictional forces. In one example, one or more springs (not shown) may be positioned to bias against the sliding member 107 to facilitate force application and adjustment.

Figure 2C:
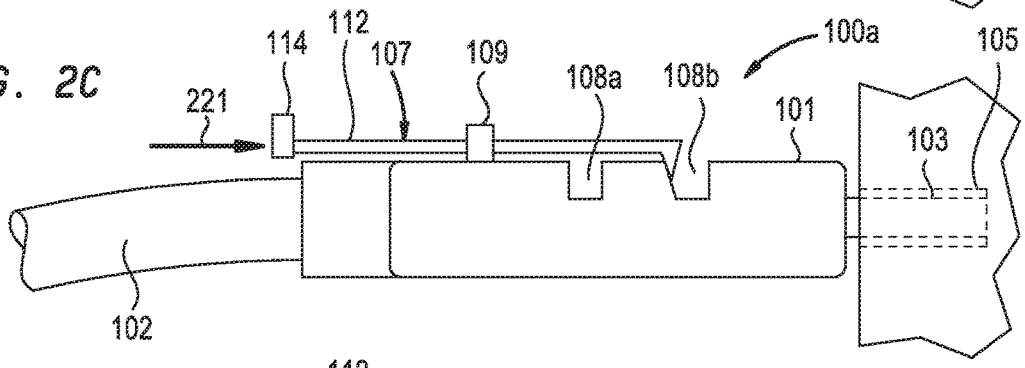

Upon application of a sufficient amount of force, the engagement member 113 is moved to the groove 108*b*, as shown in FIG. 2C. Movement of the engagement member 113 from the groove 108*a* to the groove 108*b* provides one or more of a tactile, visual, and/or audible indication that sufficient force has been provided to properly seat the cable 100*a* in the receptacle 105. The amount of force needed to move the engagement member 113 from the groove 108*a* to the groove 108*b* is above a force needed to fully and properly seat the cable 100*a* in the receptacle 105.

Figure 2D:
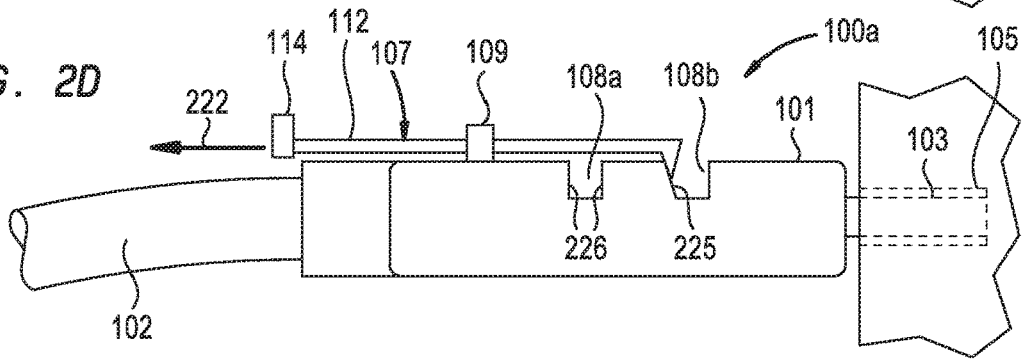

Optionally, as an additional check to confirm that the cable 100*a* is properly seated, the sliding member 107 is pulled backwards, as shown in FIG. 2D, after the engagement member has been moved to the groove 108*b*. The sliding member 107 is pulled backwards as indicated by arrow 222, which is in a direction opposite of arrow 220. The pulling motion moves the engagement member 113 from groove 108*b* to groove 108*a*. The amount of force needed to move the engagement member 113 from groove 108*b* to groove 108*a* is less than the force needed to move the engagement member 113 in the opposite direction (e.g., from groove 108*a* to groove 108*b*) and is also less than the force needed to remove the cable 100*a* from the receptacle 105. To reduce the force required to pull the sliding member 107 to the groove 108*a*, the groove 108*b* may include an angled sidewall 225. The angled sidewall 225 is disposed at an angle relative to vertical to reduce the force required to pull the engagement member 113 from the groove 108*b*. In one example, the angle of the sidewall 225 is approximately equal to the angle of a surface of the engagement member 113. In contrast, sidewalls 226 of groove 108*a* and groove 108*b* are disposed approximately vertical. Thus, the sidewalls 226 require more force to overcome with the engagement member 113 compared to the sidewall 225.

Pulling of the sliding member 107 confirms that the force gauge 106*a* was previously actuated in response to proper seating engagement with the receptacle 105, as opposed abutting a surface other than the receptacle 105. For example, if the cable 100*a* is abutting a wall or other hard surface (rather than seated in receptacle 105), it is possible to apply force to the sliding member 107 (in the direction of arrow 220), and move the sliding member 107. However, in such an example, although enough pushing force is applied to the force gauge 106*a* to indicate proper seating, the cable 100*a* may not properly seated due to misalignment or non-alignment with the receptacle 105. The additional, optional, pulling operation shown in FIG. 2D confirms that the sliding member 107 was moved in response to the cable 100*a* being properly seated, rather than the cable 100*a* being improperly located during actuation of the force gauge 106*a*. If the cable 100*a* were to not be properly seated, a user would be able to easily pull the entire cable 100*a*, rather than simply moving the sliding member 107.

Figure 2E:
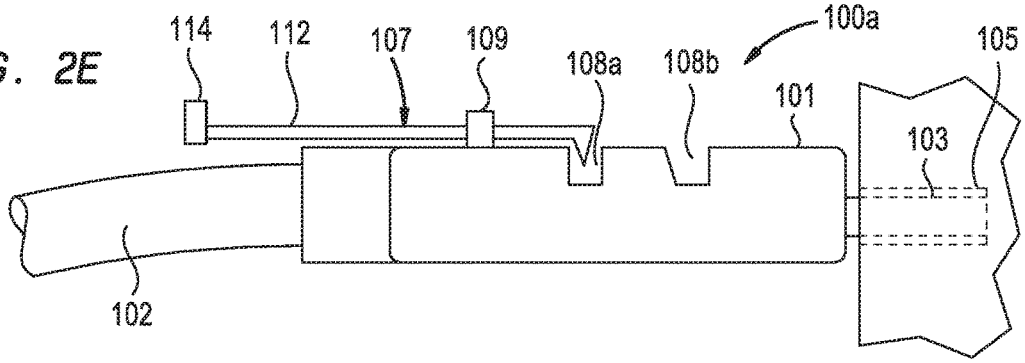

If the cable 100*a* is indeed properly seated in the receptacle 105, pulling the sliding member 107 results in movement of the engagement member 113 from the second groove 108*b* to the first groove 108*a*, without removal of the cable 100*a* from the receptacle 105, as shown in FIG. 2E. Thus, a user can confirm proper seating of the cable 100*a* using the force gauge 106*a*.

FIGS. 3A-3E are schematic top plan views of a cable 300 during force gauge implementation, according to another aspect of the disclosure. The cable 300 is similar to the cable 100*a*, but includes a back shell 301 that utilizes a force gauge 306 to confirm that the cable 300 is fully seated in the receptacle 105. The force gauge 306 includes a U-shaped sliding member 307 having opposing arms 330 coupled by a base 331. The arms 330 extend from opposite ends of the base 331. The sliding member 307 may be coupled to a back shell 301 of the cable 300 by one or more retaining members 109. In one example, a retaining member 109 is configured to engage each arm 330. The sliding member 307 includes engagement members 113 at distal ends of respective arms 330. The engagement members 113 are directed inwards towards the back shell 301. The engagement members 113 are triangular-shaped, however, other shapes such as rectangular or rounded are also contemplated. Optionally, the base 331 may include an orifice (not shown) configured to accommodate the bulk wire 102 therein, such that the base 331 is disposed around the bulk wire 102. A stop member 350 is optionally provided on the bulk wire 102 to limit the movement of the sliding member 307.

Figure 3A:
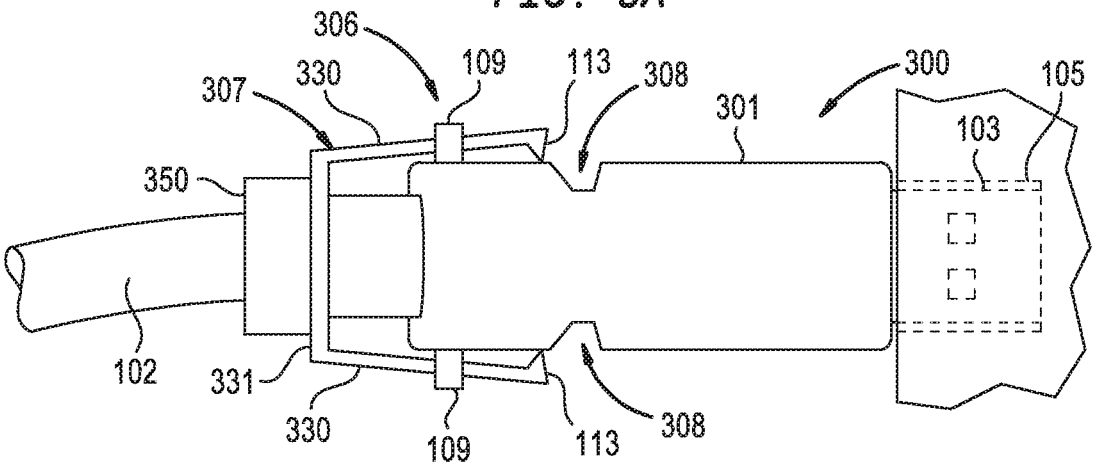
FIGS. 3A-3E are schematic top plan views of a cable during receptacle engagement, according to another aspect of the disclosure.
Figure 3B:
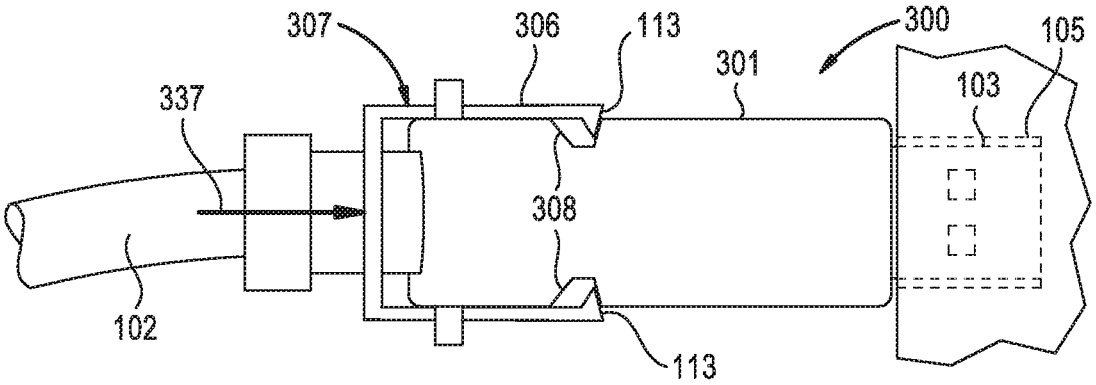

During operation, a user inserts the electrical connector 103 of the cable 300 into a receptacle 105, as shown in FIG. 3A. Subsequently, as shown in FIG. 3B, a first force is applied to the sliding member 307 of the force gauge 306, as indicated by arrow 335. Upon application of a predetermined force, such as about 20 pounds of force, the sliding member 307 is moved to a first position in which the engagement members 113 engage the grooves 308. The predetermined force is selected to be greater than a force required to fully seat the electrical connector 103 within the receptacle 105.

Figure 3C:
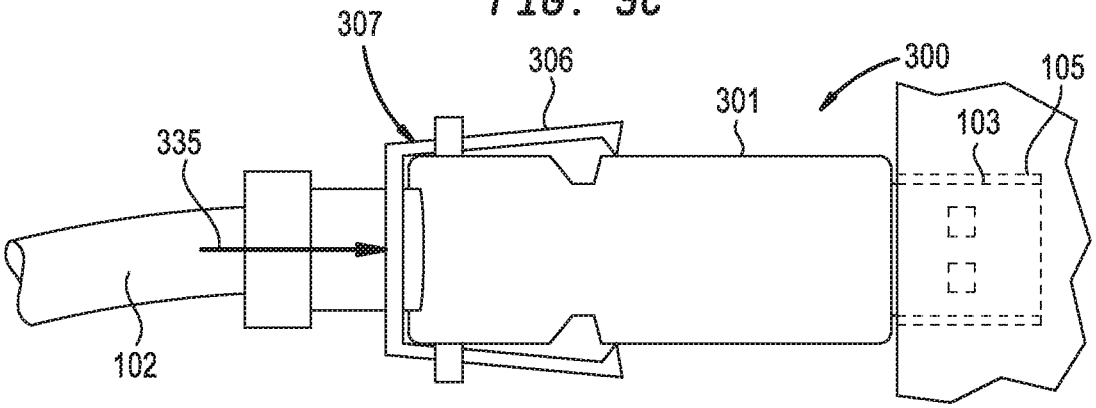

As a further confirmation of seating, the sliding member 307 of the force gauge 306 may be further actuated by application of a second force, as indicated by arrow 337. The second force is greater than the first force, for example, greater than about 20 pounds of force. Application of the second force moves the engagement members 113 out of the grooves 308 and beyond the grooves 308, as shown in FIG. 3C. Because the second force is greater than the force needed to seat the electrical connector 103 in the receptacle 105, a user is assured that a minimum cable seating force has been applied. It is to be noted that in some examples, the extra confirmation shown in FIG. 3C may be omitted. In such an example, the movement of the sliding member 307 shown in FIG. 3B may be relied upon to confirm that a minimum seating force has been applied to the cable 300.

Subsequently, the sliding member 307 may be pulled in a direction indicated by arrow 336, which is opposite the direction indicated by arrow 335. The pulling force applied with respect to FIG. 3D confirms that the connector 103 is seated within the receptacle 105 and that the connector 103 does not withdrawal from the receptacle 105. In such an example, the pulling force applied is a third force which is less in magnitude than the pushing force applied in FIGS. 3B and 3C (e.g., the first and second forces, indicated by arrows 335 and 337). In one example, the third force applied is about 10 pounds of force, or about half of the second force.

Figure 3D:
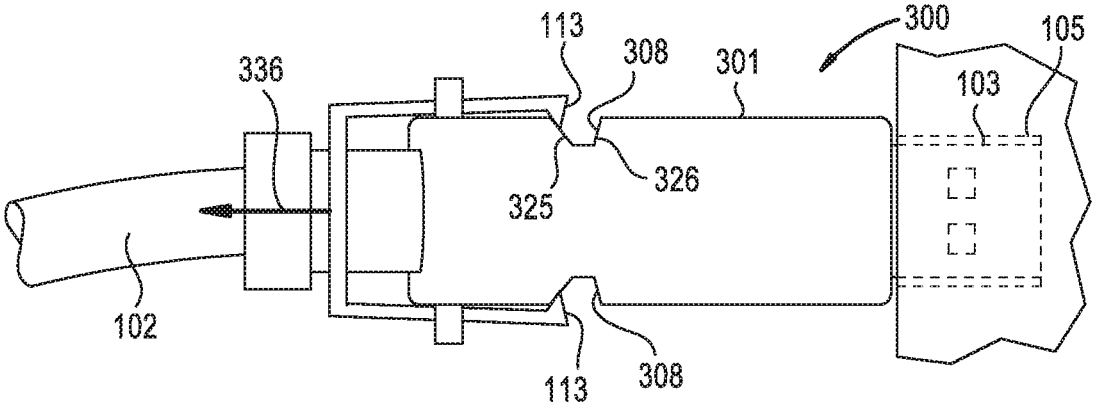

Upon application of the third force, the sliding member 307 is pulled backwards until the engagement members 113 reengage the grooves 308, as shown in FIG. 3D. In one example, as shown in FIG. 3D, the engagement members 113 engage an opposite sidewall of the grooves 308, compared to the sidewall engaged in FIG. 3B. The opposite engagement is due to the difference between a pulling versus pushing operation. It is noted however, that the grooves 308 may be sized to accommodate other engagement schemes, such as simultaneous engagement of both sidewalls of a respective groove 308. To facilitate adjustment of the relative forces needed to engage or disengage the engagement member 113 from the grooves 308, it is contemplated that the angle of the sidewalls 325, 326 may be adjusted as desired. For example, sidewall 325 may have an angle that deviates further from vertical (e.g., perpendicular from a bottom of the groove 308) than does the sidewall 326. In addition, materials having desired coefficients of friction of desired flexibility may be selected. Moreover, the components of the force gauge 306 may be sized/shaped to provide desired contact interfaces between the sliding member 307 and the back shell 301. Other methods of adjusting push/pull force thresholds are also contemplated.

Figure 3E:
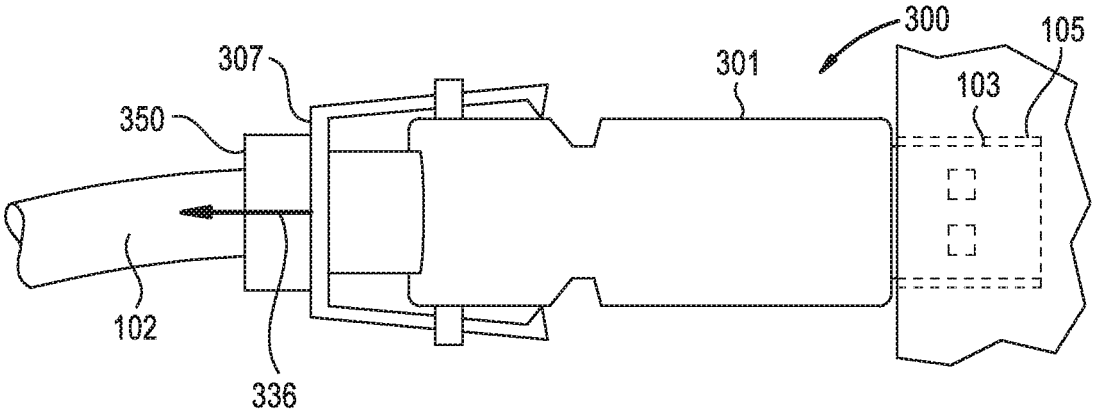

Subsequently, as shown in FIG. 3E, an optional fourth force is applied. The fourth force is a pulling force applied in a direction of the arrow 336. The fourth force is greater in magnitude than the third force, but lower in magnitude than the first and second forces. In one example, the fourth force is within a range of about 10 pounds of force to about 20 pounds of force, such as about 15 pounds of force. Application of the fourth force disengages the engagement members 113 from the grooves 308. In such an operation, the sliding member 307 is pulled backwards until the base 331 of the sliding member 307 contacts the stop member 350. Application of the fourth force confirms engagement of any retention mechanisms, such as locks or latches, present on the cable 300. However, it is to be noted that some cables may omit retention mechanisms, and thus, it is contemplated that the application of the fourth force may be omitted in these and in other circumstances.

Figure 4:
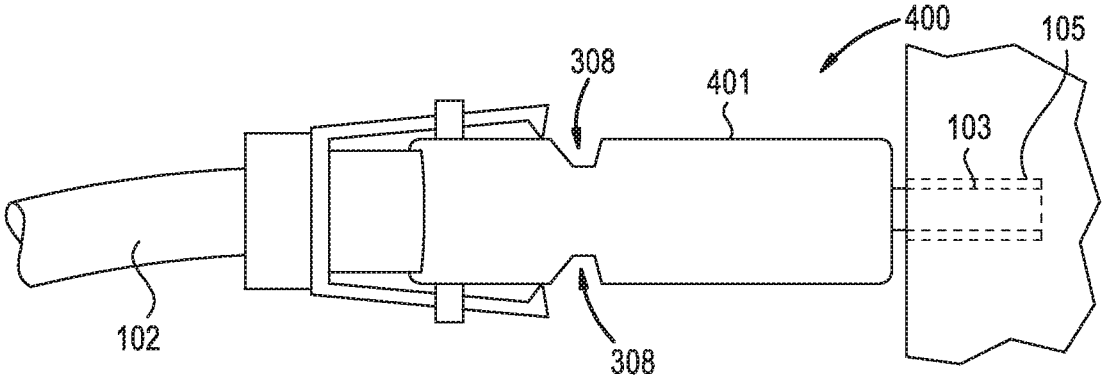
FIG. 4 is a schematic perspective of a cable, according to another aspect of the disclosure.

FIGS. 3A-3E illustrate one example of a cable 300, however, other examples are also contemplated. For example, the cable 300 utilizes a force gauge 306 having engagement members 113 that engage grooves formed in the lateral sides of a back shell 301. However, it is contemplated that the grooves 308 may be formed in upper and lower surface of the back shell 301. FIG. 4 illustrates a cable 400 having grooves 308 may be formed in upper and lower surface of the back shell 401. The cable 400 is similar to cable 300, but the sliding member 307 is rotated 90 degrees about back shell 401 such that the engagement members 113 align with the grooves 308 formed on the upper and lower surfaces of the back shell 401.

Figure 5:
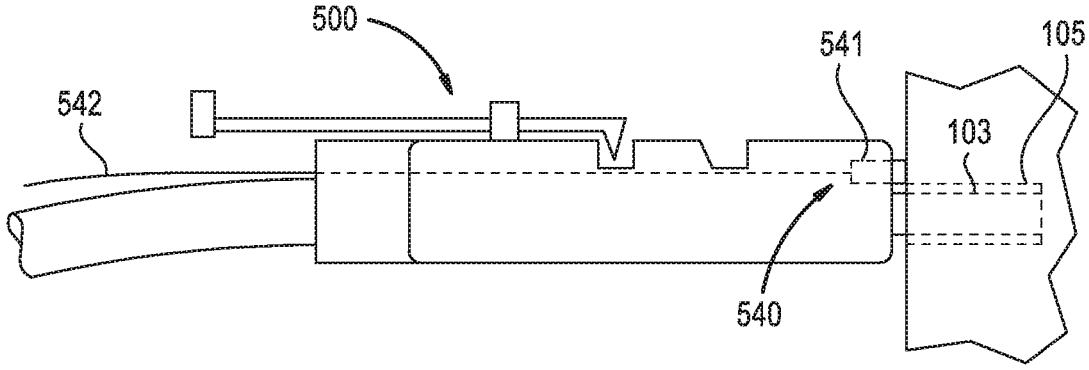
FIG. 5 is a schematic perspective of a cable, according to another aspect of the disclosure.

FIG. 5 is a schematic perspective of a cable 500, according to another aspect of the disclosure. The cable 500 is similar to the cable 100*a*, but includes a retention mechanism 540. The retention mechanism 540 includes a latch 541 releasable by a connector 542. The latch 541 may include a spring-actuated detent configured to actuate upon engagement with a receptacle, such as receptacle 105 shown in FIG. 1A. To release the latch 541, the connector 542 may be pulled in a direction away from the latch 541, thereby disengaging the latch 541 and permitting removal of the cable 500 from a receptacle. It is contemplated that the retention mechanism 540 may be incorporated into other cables described herein.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Reference is made above to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

While the foregoing is directed to embodiments of the present disclosure, other and further embodiments of the disclosure may be devised without departing from the basic scope thereof, and the scope thereof is determined by the claims that follow.

What is claimed is:

1. A cable component, comprising:

a back shell having one or more grooves formed in surfaces thereof;

a connector portion; and a sliding member coupled to the back shell, wherein the one or more grooves and the sliding member form an integrated force gauge, wherein the sliding member is positioned adjacent to the one or more grooves, the sliding member having at least one engagement member formed on a surface thereof for engaging the one or more grooves, the sliding member configured to move in a first direction upon application of a first force, wherein the first force seats the back shell and the connector portion into a receptacle at a first position and disengages the engagement member from a first groove of the one or more grooves in the first direction, and wherein the sliding member is configured to move in a second direction opposite the first direction upon application of a second force, wherein upon application of the second force, the back shell and the connector portion remain seated in the receptacle in the first position, and wherein the second force disengages the engagement member from at least one of:

(i) a second groove of the one or more grooves, and (ii) the first groove of the one or more grooves in the second direction.

2. The cable component of claim 1, wherein the sliding member is coupled to the back shell by a U-shaped or C-shaped retaining clip.

3. The cable component of claim 1, wherein the sliding member is coupled to the back shell by a slotted pin joint.

4. The cable component of claim 1, wherein the sliding member is coupled to the back shell by a plurality of tracks disposed on sides of the sliding member.

5. The cable component of claim 1, wherein the sliding member comprises a pad at an end opposite the engagement member.

6. The cable component of claim 1, wherein the one or more grooves are two grooves formed on a same surface of the back shell.

7. The cable component of claim 1, wherein the one or more grooves are two grooves formed on opposite surfaces of the back shell.

8. The cable component of claim 7, wherein the sliding member comprises a base having two arms, each of the two arms extending from the opposite sides of the base, each arm having one of the at least one engagement members coupled thereto.

9. The cable component of claim 1, wherein one of the one or more grooves has a first sidewall disposed at a first angle and a second sidewall disposed at a second angle different than the first angle.

10. A cable, comprising:

a bulk wire;

a connector portion;

a back shell coupled to the bulk wire, the back shell having one or more grooves formed in surfaces thereof; and a sliding member coupled to the back shell, wherein the one or more grooves and the sliding member form an integrated force gauge, wherein the sliding member is positioned adjacent to the one or more grooves, the sliding member having at least one engagement member formed on a surface thereof for engaging the one or more grooves, the sliding member configured to move in a first direction upon application of a first force, wherein the first force seats the back shell and the connector portion into a receptacle at a first position and disengages the engagement member from a first groove of the one or more grooves in the first direction, and wherein the sliding member is configured to move in a second direction opposite the first direction upon application of a second force, wherein upon application of the second force, the back shell and the connector portion remain seated in the receptacle in the first position, and wherein the second force disengages the engagement member from at least one of:

(i) a second groove of the one or more grooves, and (ii) the first groove of the one or more grooves in the second direction.

11. The cable of claim 10, wherein the sliding member is coupled to the back shell by a U-shaped or C-shaped retaining clip.

12. The cable of claim 10, wherein the sliding member is coupled to the back shell by a slotted pin joint.

13. The cable of claim 10, wherein the sliding member is coupled to the back shell by a plurality of tracks disposed on sides of the sliding member.

14. The cable of claim 10, wherein the sliding member comprises a pad at an end opposite the engagement member.

15. The cable of claim 10, wherein the one or more grooves are two grooves formed on a same surface of the back shell.

16. The cable of claim 10, wherein the one or more grooves are two grooves formed on opposite surfaces of the back shell.

17. The cable of claim 16, wherein the sliding member comprises a base having two arms, each of the two arms extending from the opposite sides of the base, each arm having one of the at least one engagement members coupled thereto.

18. The cable of claim 10, wherein one of the one or more grooves has a first sidewall disposed at a first angle and a second sidewall disposed at a second angle different than the first angle.

19. A method, comprising:

positioning an electrical connector of a cable in a receptacle;

applying a first force to a sliding member of a force gauge integrated into the electrical connector of the cable to move the sliding member from a first position to a second position relative to one or more grooves formed in a back shell of the cable, wherein the first force seats the electrical connector into the receptacle at a first position and disengages an engagement member from a first groove of the one or more grooves in a first direction;

applying a second force to the sliding member to move the sliding member from the second position to the first position relative to the back shell of the cable, the second force directed in an opposite direction than the first force and, wherein upon application of the second force, the electrical connector remains seated in the receptacle in the first position, and wherein the second force disengages the engagement member from at least one of:

(i) a second groove of the one or more grooves, and (ii) the first groove of the one or more grooves in a second direction, and wherein the electrical connector remains positioned in the receptacle upon application of the second force.

20. The method of claim 19, wherein the sliding member engages the first groove formed in the back shell in the first position and the second groove formed in the back shell in the second position.

* * * * *